US006565178B1

(12) United States Patent
Giere et al.

(10) Patent No.: US 6,565,178 B1
(45) Date of Patent: May 20, 2003

(54) TEMPERATURE MEASUREMENT DEVICE

(75) Inventors: Matthew D Giere, San Diego, CA (US); Satya Prakash, Poway, CA (US); Michael J. Barbour, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/002,751

(22) Filed: Oct. 29, 2001

(51) Int. Cl.[7] ..... B41J 29/38
(52) U.S. Cl. ..... 347/17
(58) Field of Search ..... 347/17, 14, 23, 347/19, 49, 86, 40, 7; 358/298; 400/121, 126

(56) References Cited

U.S. PATENT DOCUMENTS 5,644,343 A 7/1997 Allen
5,648,805 A 7/1997 Keefe et al.
6,276,777 B1 8/2001 Schiaffino et al.

*Primary Examiner*—Raquel Yvette Gordon
*Assistant Examiner*—Charles W. Stewart, Jr.
(74) *Attorney, Agent, or Firm*—Gregg W. Wisdom

(57) ABSTRACT

An apparatus includes a substrate and a resistive element attached to a region of the substrate and formed of a first material having a first temperature coefficient of resistivity. In addition, the apparatus includes a pair of traces coupled to the resistive element, attached to the substrate, and formed of a second material having a second temperature coefficient of resistivity with the first material selected so that the first temperature coefficient of resistivity exceeds the second temperature coefficient of resistivity. An apparatus includes a substrate and a resistive element disposed onto a first region of the substrate and formed of a first material having a first temperature coefficient of resistivity. In addition, the apparatus includes a pair of traces coupled to the resistive element and each formed of a first plurality of sections of a second material having a second temperature coefficient of resistivity and a second plurality of sections of a third material having a third temperature coefficient of resistivity.

31 Claims, 6 Drawing Sheets

TEMPERATURE MEASUREMENT DEVICE

INTRODUCTION

Imaging devices that form images on media by ejecting colorant onto media make use of one or more printheads. The printheads include arrays of nozzles that have openings coupled to chambers. Adjacent to the chambers are resistive elements used for heating the ink to cause the ink in the chambers to eject from the nozzles. The quality of the image formed from the ejected ink is influenced by the consistency in the quantity of ink ejected from the nozzles. The consistency in the quantity of ink ejected from the nozzles is affected by the temperature of the chambers. Temperature related adjustment of the power supplied to the resistors can at least partially compensate for temperature related variation in the quantity of ink ejected from the nozzles and for changes in the operating temperature of the printhead. Inaccuracies in the measurement of the temperature of the printhead can reduce the effectiveness of the compensation for temperature related changes in the quantity of ink ejected from the nozzles.

SUMMARY OF THE INVENTION

An apparatus includes a substrate and a resistive element attached to a region of the substrate and formed of a first material having a first temperature coefficient of resistivity. In addition, the apparatus includes a pair of traces coupled to the resistive element, attached to the substrate, and formed of a second material having a second temperature coefficient of resistivity with the first material selected so that the first temperature coefficient of resistivity exceeds the second temperature coefficient of resistivity.

An apparatus includes a substrate and a resistive element disposed onto a first region of the substrate and formed of a first material having a first temperature coefficient of resistivity. In addition, the apparatus includes a pair of traces coupled to the resistive element and each formed of a first plurality of sections of a second material having a second temperature coefficient of resistivity and a second plurality of sections of a third material having a third temperature coefficient of resistivity.

DESCRIPTION OF THE DRAWINGS

A more thorough understanding of embodiments of the temperature measurement system may be had from the consideration of the following detailed description taken in conjunction with the accompanying drawings in which:

Shown in FIG. 1 is an embodiment of an inkjet printer including a printhead that uses an embodiment of the temperature measurement system.

Figure 2:
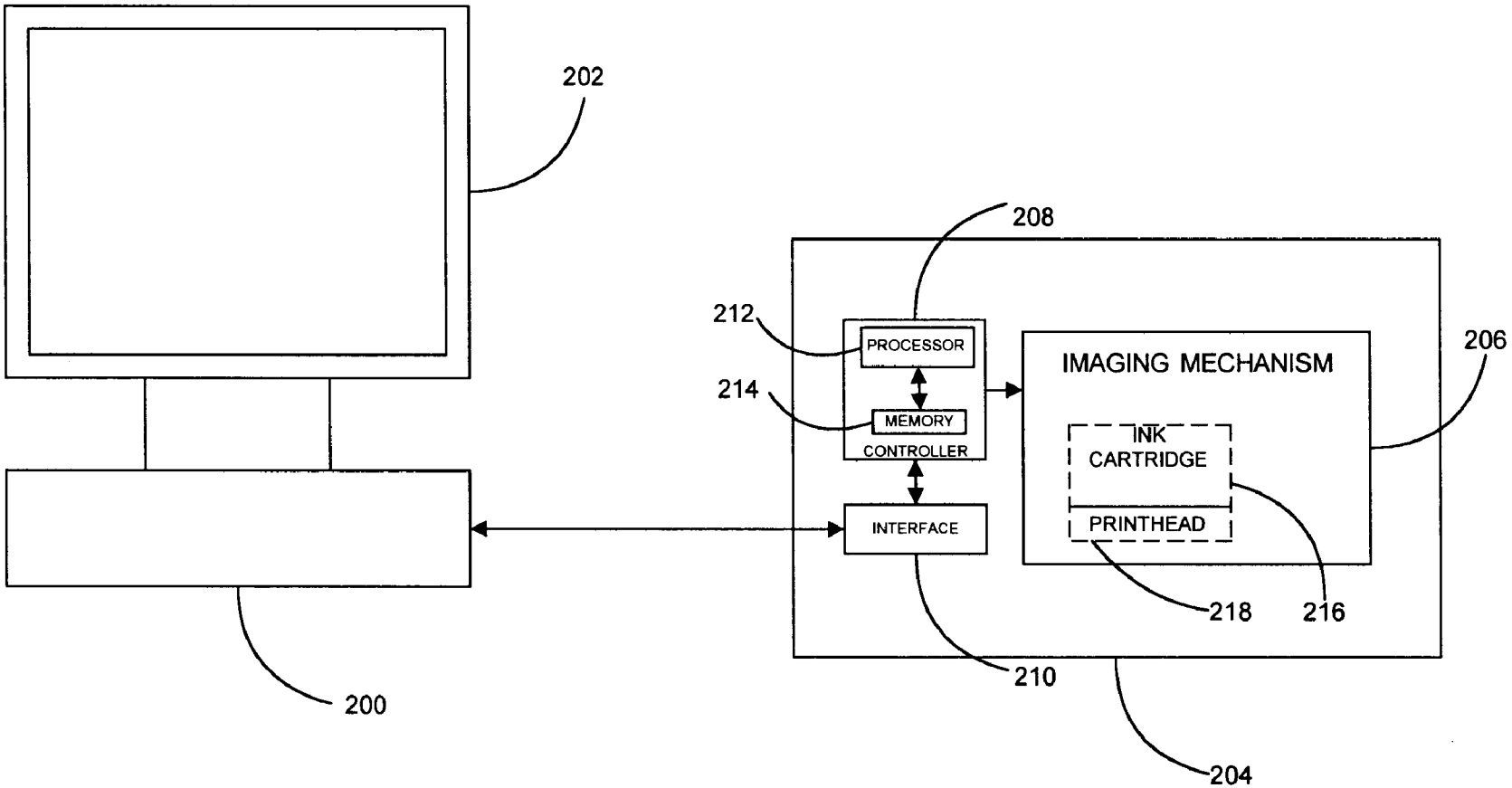

Shown in FIG. 2 is a high level block diagram of an embodiment of an inkjet imaging device that uses an embodiment of the temperature measurement system.

Figure 3:
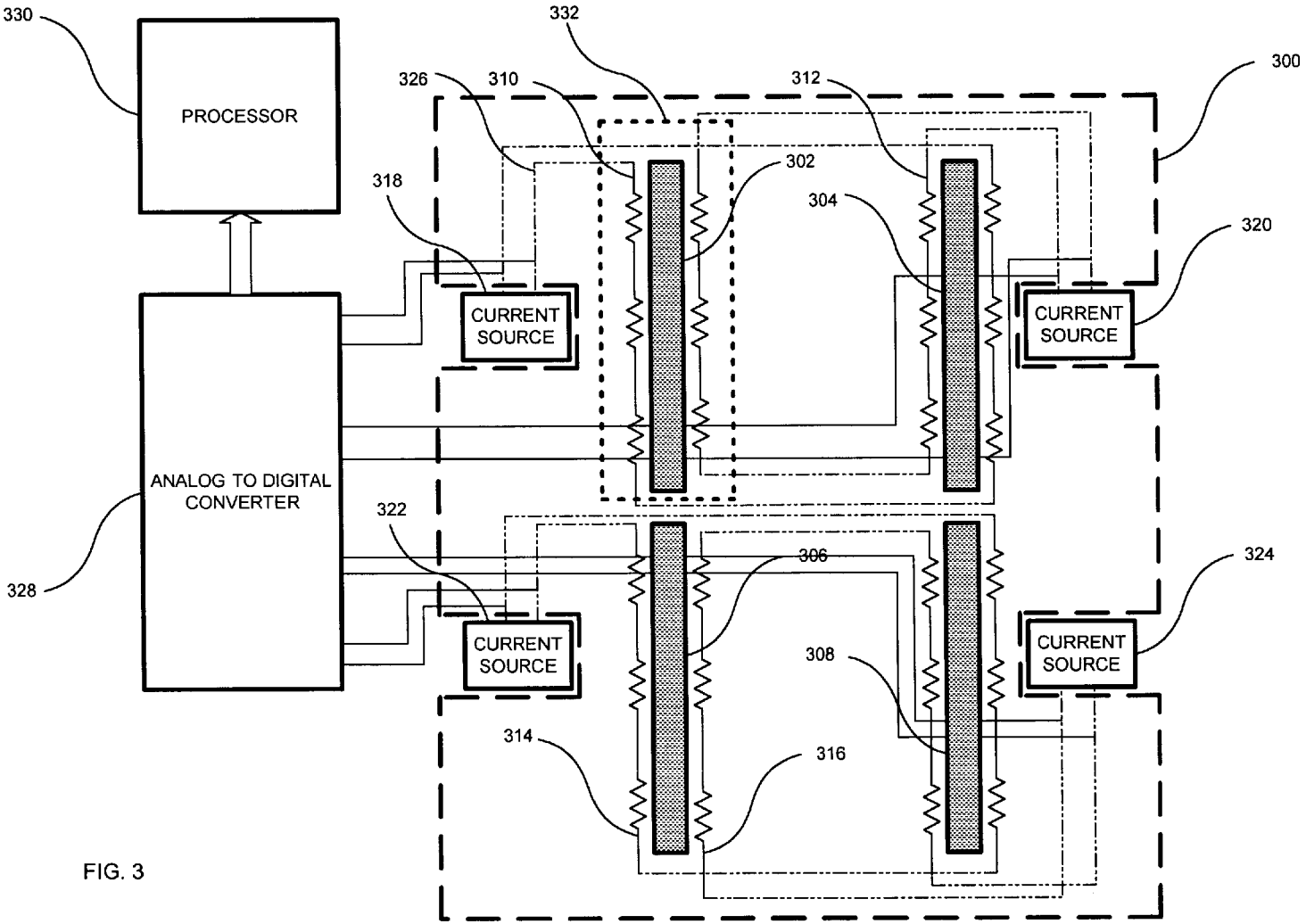

Shown in FIG. 3 is a high level schematic diagram of an embodiment of the temperature measurement system.

Figure 4:
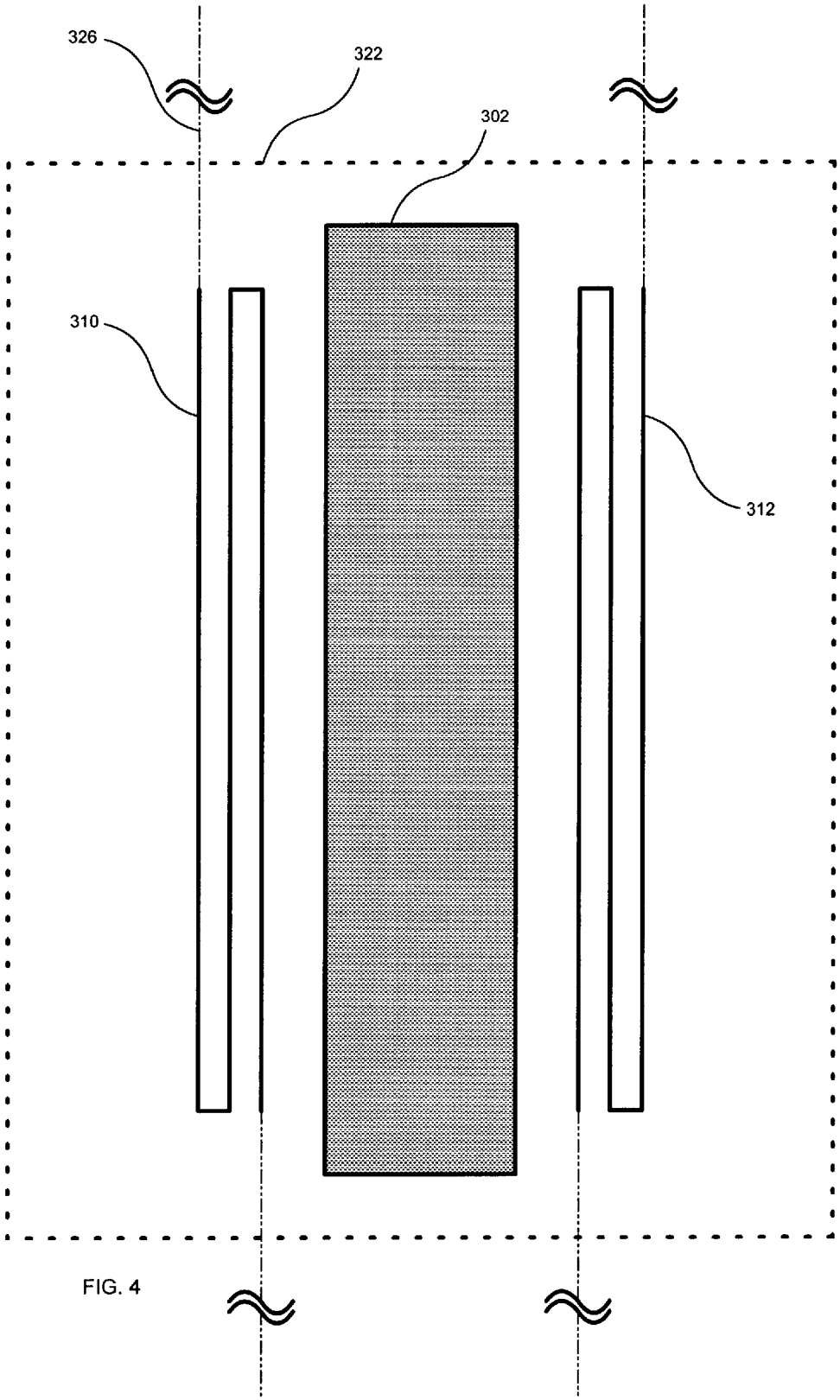

Shown in FIG. 4 is a schematic diagram of a portion of the temperature measurement system.

Figure 5A:
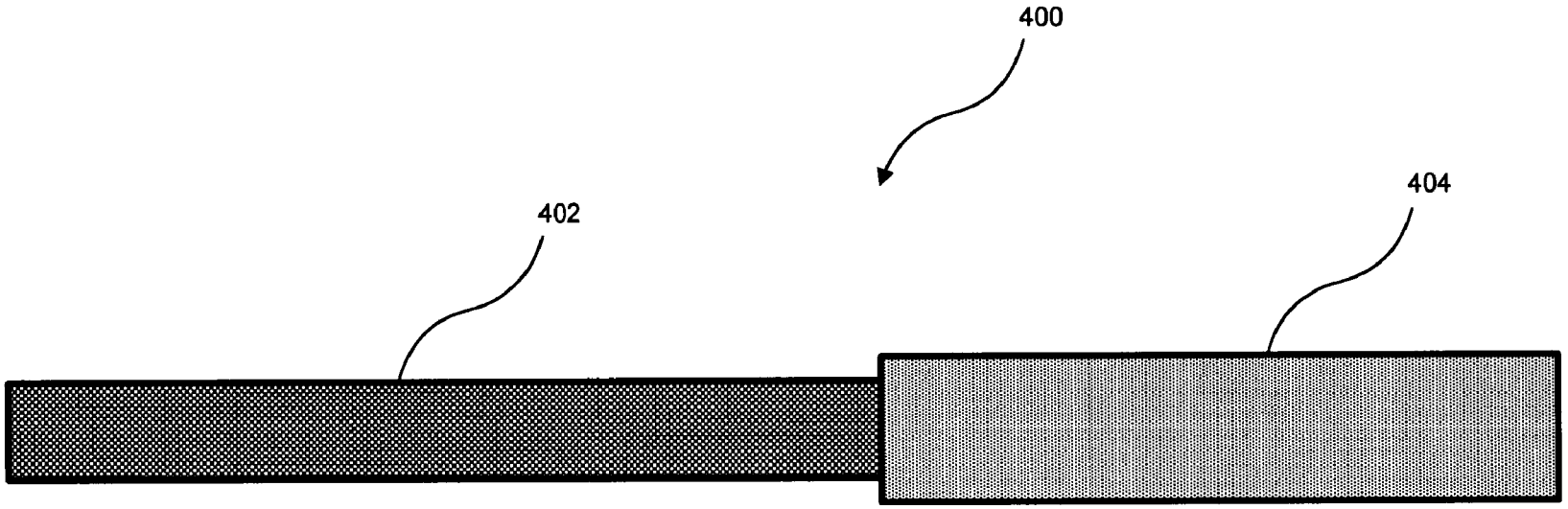
Figure 5B:
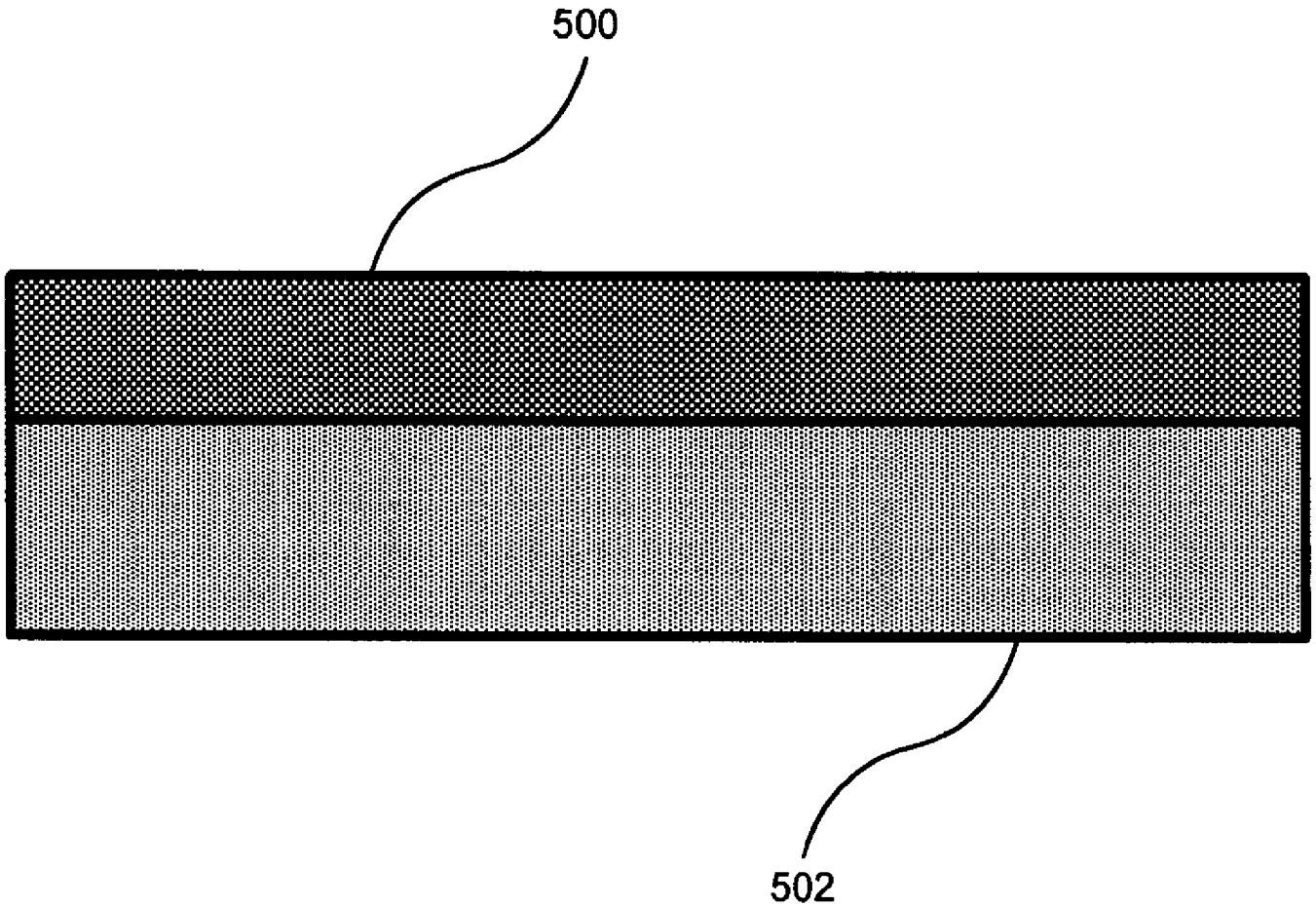

Shown in FIG. 5A and FIG. 5B are alternative embodiments of traces that could be used in embodiments of the temperature measurement system.

DETAILED DESCRIPTION OF THE DRAWINGS

Although embodiments of the temperature measurement system will be disclosed in the context of an embodiment of an inkjet printer, it should be recognized that embodiments of the printhead could be usefully applied to other types of imaging devices. Embodiments of the temperature measurement system are applicable in a variety of imaging devices making use of thermal inkjet technology. For example, embodiments of the temperature measurement system could be used to improve the performance of large format inkjet plotters, facsimile machines using thermal inkjet technology, copiers using thermal inkjet technology, inkjet imaging devices that perform cancellation of postage, or inkjet imaging devices that perform marking onto packages. In general, embodiments of the temperature measurement system can be usefully applied in imaging devices that make use of one or more printheads to eject a colorant, such as ink, onto surfaces. Furthermore, although an embodiment of the temperature measurement system will be discussed in the context of an inkjet printer using a movable printhead, embodiments of the temperature measurement system can be usefully implied in inkjet printers having stationary printheads. In addition, although an embodiment of the temperature measurement system will be discussed in the context of a color inkjet printer, it will be recognized by understanding the information within this disclosure that embodiments of the temperature measurement system can be usefully applied in a monochrome inkjet imaging device.

Inkjet imaging devices such as printers, large format plotters/printers, facsimile machines and copiers have gained wide acceptance. These imaging devices are described by W. J. Lloyd and H. T. Taub in "Ink Jet Devices," Chapter 13 of Output Hardcopy Devices (Ed. R. C. Durbeck and S. Sherr, San Diego: Academic Press, 1988) and U.S. Pat. Nos. 4,490,728 and 4,313,684. The basics of this technology are further disclosed in various articles in several editions of the Hewlett-Packard Journal [Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994)], incorporated into this specification by reference. Inkjet imaging devices can produce high quality images on media, are generally compact and portable, and form images on media quickly and quietly because only ink strikes the media.

An inkjet imaging device, such as an inkjet printer, forms a image by depositing a pattern of individual drops of ink on the media at particular locations of an array defined for the media. The locations are conveniently visualized as small dots in a rectilinear array. These locations are typically referred to as pixels. The imaging operation can be viewed as the filling of a pattern of pixels with drops of ink.

Inkjet imaging devices fill the pixels by ejecting very small drops of ink onto the media and typically include a movable carriage that supports one or more printheads each having ink ejecting nozzles. The carriage traverses over the surface of the media, and the nozzles are controlled to eject drops of ink at appropriate times pursuant to command of a microcomputer or other controller, wherein the timing of the application of the ink drops is intended to correspond to the pattern of pixels of the image being formed.

The typical inkjet printhead (i.e., a silicon substrate having a plurality of thin film layers, structures built on the substrate, and connections to the substrate) uses liquid ink (i.e., dissolved colorants or pigments dispersed in a solvent). It has an array of precisely formed orifices or nozzles attached to a printhead substrate that incorporates an array of ink ejection chambers which receive liquid ink from the ink reservoir. Each chamber is located opposite the nozzle so ink can collect between it and the nozzle. The ejection of ink droplets is typically done under the control of a microprocessor, the signals of which are conveyed by electrical traces to the ink ejection element. The ink ejection element includes a firing resistor. When electric printing pulses are supplied to the firing resistor, a small portion of the ink next to it vaporizes and ejects a drop of ink from the printhead. Properly-arranged nozzles form a matrix pattern. Properly sequencing the operation of each nozzle causes characters or images to be printed upon the media as the printhead moves past the media. The quantity of an ejected ink drop could be measured based upon the volume of the ejected ink drop, based upon the mass of the ejected ink drop, or based upon the weight of an ink drop. Typically, measurement of a quantity of an ejected ink drop is done in terms of mass. Therefore, this specification will discuss the operation of embodiments of the temperature measurement system in terms of the mass of ejected ink drops.

The ink cartridge containing the nozzles is moved repeatedly across the width of the media upon which the image will be formed. At each of a designated number of increments of this movement across the media, each of the nozzles is caused either to eject ink or to refrain from ejecting ink according to output generated by the controlling microprocessor. Each completed movement across the media can deposited ink onto pixels forming a swath approximately as wide as the number of nozzles arranged in a column of the ink cartridge multiplied by the distance between nozzle centers, with the swath as long the dimension of the media parallel to the direction of relevant movement between the media and the printhead. After each such completed swath, the media is moved forward the width of the swath, and the ink cartridge begins the next swath. By proper selection and timing of the signals, the desired image is formed on the media.

In an inkjet printhead ink, is fed from an ink reservoir integral to the printhead or an "off-axis" ink reservoir which feeds ink to the printhead via tubes connecting the printhead and reservoir. Ink is then fed to the various ink ejection chambers either through an elongated hole formed in the center of the bottom of the substrate, "center feed," or around the outer edges of the substrate, "edge feed." In center feed the ink then flows through a central slot in the substrate into a central manifold area formed in a barrier layer between the substrate and a nozzle member, then into a plurality of ink channels, and finally into the various ink ejection chambers. In edge feed ink from the ink reservoir flows around the outer edges of the substrate into the ink channels and finally into the ink ejection chambers. In either center feed or edge feed, the flow path from the ink reservoir and the manifold inherently provides restrictions on ink flow to the ink ejection chambers.

Color inkjet imaging devices commonly employ a plurality of print cartridges, usually two to four, mounted in the printer carriage to produce a full spectrum of colors. In a printer with four cartridges, each print cartridge can contain a different color ink, with the commonly used base colors being cyan, magenta, yellow, and black. In a printer with two cartridges, one cartridge can contain black ink with the other cartridge being a tri-compartment cartridge containing the base color cyan, magenta and yellow inks, or alternatively, two dual-compartment cartridges may be used to contain the four color inks. In addition, two tri-compartment cartridges may be used to contain six base color inks, for example, black, cyan, magenta, yellow, light cyan and light magenta. Further, other combinations can be employed depending on the number of different base color inks to be used.

The base colors are produced on the media by depositing a drop of the required color onto a pixel location, while secondary or shaded colors are formed by depositing multiple drops of different base color inks onto the same or an adjacent pixel location, with the overprinting of two or more base colors producing the secondary colors according to well established optical principles.

In a color imaging operation, the various colored ink drops ejected by each of the print cartridges are selectively overlapped to create crisp images composed of virtually any color of the visible spectrum. To create a single pixel on media having a color which requires a blend of two or more of the colors provided by different print cartridges, the nozzle plates on each of the cartridges must be precisely aligned so that a drop ejected from a selected nozzle in one cartridge overlaps a drop ejected from a corresponding nozzle in another cartridge.

The print quality produced from an inkjet device is dependent upon the reliability and drop quantity repeatability of its ink ejection elements. A multi-pass print mode can partially mitigate the impact of the malfunctioning ink ejection elements on the print quality. The concept of printmodes is a useful and well-known technique of laying down in each pass of the printhead only a fraction of the total ink required in each section of the image, so that any areas left white in each pass are filled in by one or more later passes. This tends to control bleed, blocking and cockle by reducing the amount of liquid that is on the page at any given time.

The specific partial-inking pattern employed in each pass, and the way in which these different patterns add up to a single fully inked image, is known as a "printmode." Printmodes allow a trade-off between speed and image quality. For example, a printer's draft mode provides the user with readable text as quickly as possible. Presentation, also known as best mode, is slow but produces the highest image quality. Normal mode is a compromise between draft and presentation modes. Printmodes allow the user to choose between these trade-offs. It also allows the printer to control several factors during printing that influence image quality, including: 1) the amount of ink placed on the media per pixel location, 2) the speed with which the ink is placed, and, 3) the number of passes required to complete the image. Providing different printmodes to allow placing ink drops in multiple swaths can assist in hiding nozzle defects. Different printmodes are also employed depending on the media type.

One-pass mode operation is used for increased throughput on plain paper media. Use of this mode on certain other types of paper media, such as coated paper, will result in dots resulting from the ink drops that are too large. In a one-pass mode, ink drops are placed onto all pixels onto which ink is to be deposited in the swath in one pass of the printhead across the swath. Then, the media is advanced into position for the next swath. In a two-pass printmode, one-half of the pixels available for ink deposition, on the rows of pixels forming the swath, are deposited on each of two passes of the printhead across the swath. Therefore, two passes are needed to complete the ink deposition for that swath. Similarly, a four-pass mode is a method of placing ink drops onto pixels where one fourth of the pixels onto which ink is to be deposited for the swath are deposited on each of four passes of the printhead across the swath. Furthermore, an eight-pass mode is a method of depositing ink onto pixels where one eighth of the pixels onto which ink is to be deposited for the swath are deposited on each eight passes of the printhead across the swath. Multiple pass thermal inkjet printing is described, for example, in commonly assigned U.S. Pat. Nos. 4,963,882 and 4,965,593, incorporated by reference into this specification in their entirety. In general, it is desirable to use the minimum number of passes for each swath to complete the imaging operation to maximize the printer throughput and to reduce undesirable visible printing artifacts.

In forming an image on media, the color of a region of the image is related to the quantity of each of the different colors used to form the image in the area. In a small region of the image formed including a relatively low number of pixels, the color perceived from that region depends upon the relative quantity of the different colors of ink drops deposited onto the pixels. Consider the formation of a neutral gray color in the region through the deposition of predetermined quantities of cyan ink, yellow ink, and magenta ink. In the L*a*b* color space, the neutral gray color region will reside at the intersection of a* and b* axes along the L* axis. With the proper quantities of each of the cyan ink, the yellow ink, and the magenta ink ejected onto the region the resulting color of the region is at the neutral gray point (the intersection of the a* axis and the b* axis) as intended.

In general, the quantity of ink drops ejected from a printhead nozzle will change as the temperature of the structure surrounding the ink ejection chamber associated with the nozzle changes. Generally, the mass of ejected ink drops increases as the temperature of the structure surrounding the ink ejection chamber increases. The underlying physical effects that tend to increase the ejected ink drop mass include changes in ink surface tension, changes in ink viscosity, and changes in energy available for bubble nucleation. For the formation of the previously mentioned neutral gray region each of the cyan, magenta, and yellow printheads operate at or near a nominal operating temperature so that when control signals intended to cause ejection of the quantities of ink necessary to form a neutral gray color in the region are supplied to the respective printheads, the respective printheads actually eject the quantities of ink onto the pixels necessary to form a neutral gray color region.

The rate at which signals are supplied to resistors associated with the ink ejection chambers affects the temperature of the substrate of the printhead. For a printhead where there is no attempt made to stabilize the temperature of the substrate, the temperature of the substrate can change substantially during use of the printhead depending upon changes in the firing frequency of the nozzles over time. Localized heating of the substrate can occur from firing nozzles at a greater frequency in a particular region of the printhead. The localized heating effect can more readily occur for larger size printheads than smaller size printheads because of the larger thermal resistance across the substrate of the larger size printheads as compared to smaller size printheads. If at least some compensation is not made for these temperature changes, a perceptible degradation in print quality can result.

Consider the condition in which the operating temperature of the magenta printhead increases beyond the nominal operating temperature. This may occur, for example, from an increased firing frequency of the magenta printhead. As a result of the temperature increase of the ink ejection chambers in the magenta printhead, the mass of a magenta ink drop ejected from nozzles in the magenta printhead will increase beyond the mass necessary (in combination with the ink drops ejected from the yellow printhead and the cyan printhead) to create the neutral gray color of the region. As a result of the excessive quantity of magenta ink applied, the hue of the region formed will be shifted toward the magenta hue. In a similar fashion, variations in the ejected mass of ink drops can cause undesired shifts in the chroma and the luminance of regions. Additionally, consider an image that includes sharp edges. The increase in the mass of ejected ink drops can reduce the sharpness of the edges when the image is formed onto paper.

A variety of techniques are used to compensate for the change in ejected ink quantity with temperature. One way to compensate for the change in ejected ink quantity with temperature is to provide one or more heaters to heat the substrate. Heating the substrate will reduce the range of temperature change experienced by the printhead as the firing frequency of the nozzles changes. The temperature of the substrate is measured and compared to a target value. Depending upon the temperature difference between the measured substrate temperature and the target substrate temperature, the power supplied to the substrate heater is changed (taking into account the heating that will occur from firing nozzles) to reduce the magnitude of the difference. Further information on this technique can be found in U.S. Pat. Nos. 5,736,995 and 5,673,069 each of which are assigned to Hewlett-Packard Company and each of which are incorporated by reference in their entirety into this specification.

Another technique used to compensate for a temperature related change in ink drop mass is to change the mass of ink ejected from the nozzles as a function of temperature. In this technique, a measurement of substrate temperature is used to adjust the quantity of ink ejected from the nozzles over a region in a way (such as through a temperature dependency of a halftoning operation) that offsets the temperature dependency in the quantity of ink ejected from the nozzles. The efficacy of either of the techniques to compensate for a temperature related change in ink drop mass is improved by accurate measurement of the temperature of the temperature of the substrate.

To achieve ejection of ink from nozzles in a printhead a minimum amount of energy must be applied to a firing resistor during a limited time interval to rapidly vaporize ink and eject ink from a nozzle. As the energy supplied during the time interval to the firing resistor increases the quantity of ink ejected will also increase until a limit is reached beyond which the application of additional energy during the time interval will not substantially change the quantity of ejected ink. The energy required during the limited time interval is dependent upon the temperature of the structure surrounding an ink chamber associated with the nozzle. As the temperature of the surrounding structure increases, the energy that must be applied to the firing resistor to cause ink ejection decreases. Typically, the energy supplied to the firing resistor during the time interval is somewhat greater than the minimum amount of energy required to cause ejection of the maximum quantity of ink. This amount of energy will decrease as the temperature of the structure surrounding the ink chamber increases. For reliability purposes it is desirable to supply the minimum amount of energy possible to the firing resistors to achieve ejection of the maximum quantity of ink.

One way in which to control the amount of energy supplied to the firing resistors is through adjustment of the pulse width of the applied drive signal as a function of the measured temperature of the substrate. To accurately set the energy supplied to the firing resistors near the ideal level, accurate measurement of the temperature of the substrate in the region near the nozzles for which the energy supplied is helpful. This can become a more difficult task when, because of the physical size of the substrate, substantial temperature differences can be established between different regions on the substrate. This may be the case when the printhead includes multiple regions, each having a plurality of nozzles and associated firing resistors.

Figure 1:
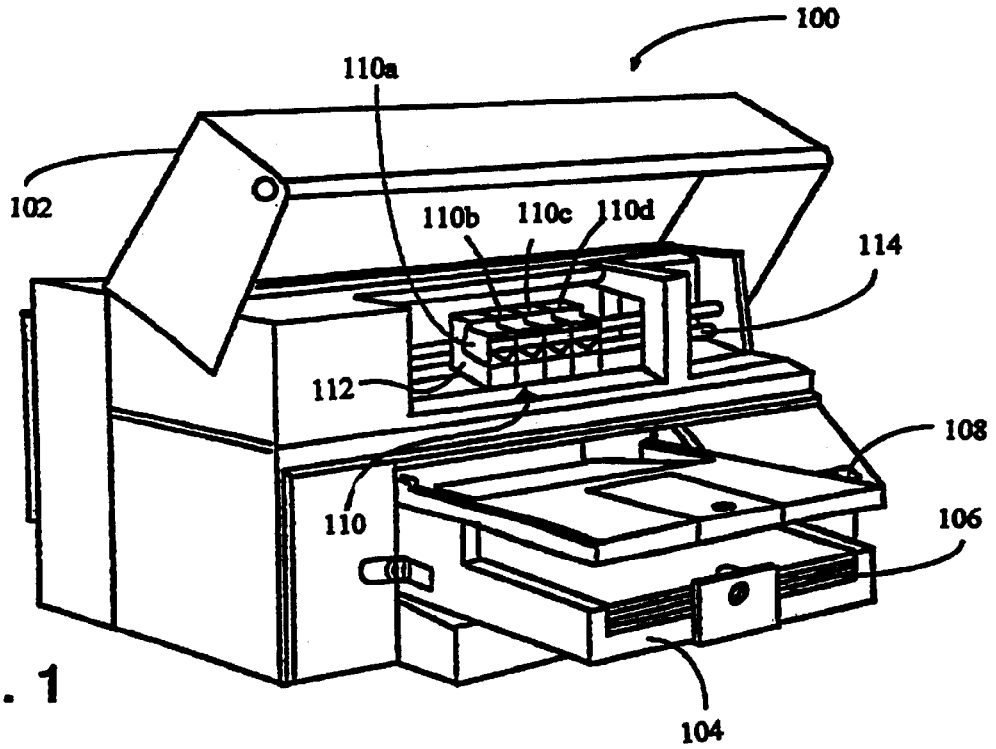

Shown in FIG. 1 is an embodiment of an imaging device, color inkjet printer 100, that includes an embodiment of the temperature measure system. Color inkjet printer 100 includes a cover 102, a media input tray 104 for holding media 106 to be used in an imaging operation, a media output tray 108 for receiving the units of media 106 on which images have been formed, color ink cartridges 110 (including a cyan cartridge 110*a*, a magenta (M) cartridge 110*b*, a yellow (Y) cartridge 110*c*, and a black (K) cartridge 110*d*), and a scanning carriage 112 for sliding along a slide bar 114 while colorant from one or more of color cartridges 110 is placed onto pixels. In color inkjet printer 100, the colorant stored in color cartridges 110 includes ink. Printheads included within cyan cartridge 110*a*, a magenta (M) cartridge 110*b*, a yellow (Y) cartridge 110*c*, and a black (K) cartridge 110*d*) implement parts of the temperature measurement system.

Shown in FIG. 2 is a block diagram representation of a system used for forming images on media 106. The system includes a computer 200. Computer 200 may execute an application program to generate data corresponding to an image displayed on monitor 202 (such as a CRT) or retrieve the data corresponding to the image from a storage device included within computer 200 through the application program. Typically, monitor 202 will display an image using an RGB color space and 24 bits (8 bits for each primary color) to specify the color value for each monitor pixel. An embodiment of an imaging device, inkjet printer 204 is coupled to computer 200.

Printer 204 may include color inkjet printer 100 or other types of inkjet imaging devices. Printer 204 includes the capability to form color images upon media 106 using a set of colorants (such as ink or toner) forming a color space (e.g. cyan, magenta, and yellow and optionally black). Printer 204 may be configured to form images at 300 dpi, 600 dpi, 1200 dpi, or other resolutions. A printer driver program that can execute in computer 200 converts the data (corresponding to the image) received from the application program into a form useable by printer 204, such as a page description language (PDL) file. The PDL file may include for example a file defined in HEWLETT PACKARD'S PCL-3 or PCL-5 format.

Printer 204 renders the PDL file to generate pixel data including a color value for each pixel of each of the color planes forming the image. For example, an embodiment of printer 204 may generate color values for pixels forming the cyan, magenta, yellow, and black color planes. The color values for each of the pixels in the color planes may range, for example, from 0–255. A halftoning operation may be performed upon the color values of the color planes to generate halftone data for the image. The halftone data includes binary data specifying for each of the pixels in each of the color planes whether colorant for that color plane will be placed onto the pixel. Alternatively, the image may be formed using the color values for each of the pixels in each of the color planes without halftoning. For this alternative, the quantity of colorant placed onto the pixel is directly related to the color value for the pixel. In an inkjet imaging device, the quantity of the colorant is controlled by the number of drops of ink of a specific color placed onto the region of the media corresponding to the pixel. Included in printer 204 is an embodiment of an image forming mechanism, imaging mechanism 206. Imaging mechanism 206 includes the hardware necessary to place colorant on media 106.

An embodiment of a controller, such as controller 208, coupled to imaging mechanism 206 controls the placement of colorant onto media 106 by imaging mechanism 206 making use of the halftone data or color values for the pixels forming each of the color planes. The output from the printer driver software executing in computer 200 is passed through interface 210 to controller 208. Controller 208 includes the capability to render the PDL file received from computer 200 to generate pixel data for each of the pixels forming the image. Controller 208 includes an embodiment of a processing device, such as processor 212 configured to execute firmware or software, or an application specific integrated circuit (ASIC) for controlling the placement of colorant onto media 106 by imaging mechanism 206. In addition, controller 208 includes an embodiment of a memory device, such as memory 214 for storing halftone data or color values for the pixels forming the image. Processor 212 also includes a configuration to execute code for performing an embodiment of the temperature measurement system.

Imaging mechanism 206 includes one or more ink cartridges, of which ink cartridge 216 is exemplary, movably mounted on a carriage with its position precisely controlled by a belt driven by a stepper motor. An ink cartridge driver circuit coupled to the controller and the ink cartridges fires nozzles on printheads, of which printhead 218 is exemplary, included in the ink cartridges based upon signals received from the controller to place colorant on media 106 according to the halftone data or color values for the pixels forming each of the color planes. The printheads included within these ink cartridges include hardware associated with an embodiment of the temperature measurement system described later in this specification. Further detail on embodiments of imaging mechanisms used in color inkjet printers can be found in U.S. Pat. No. 6,082,854, entitled MODULAR INK-JET HARD COPY APPARATUS AND METHODOLOGY, issued to Axtell et al., and assigned to Hewlett-Packard Company, and U.S. Pat. No. 5,399,039, entitled INK-JET PRINTER WITH PRECISE PRINT ZONE MEDIA CONTROL, issued to Giles et al., and assigned to Hewlett-Packard Company. Each of these two patents is incorporated by reference in their entirety into this specification.

Shown in FIG. 3 is a high level schematic diagram of an embodiment of the temperature measurement system implemented upon an embodiment of a printhead. The printhead is formed upon substrate 300. Although not shown in FIG. 3 for ease of illustration, substrate 300 includes the structures of a typical printhead such as, ink feed slots, ink ejection chambers, firing resistors, etc. Regions 302, 304, 306, and 308 each include an array of nozzles and associated firing resistors for ejecting ink. Resistive elements 310, 312, 314, and 316 are formed from material having a known temperature coefficient of resistivity. Resistive elements 310, 312, 314, and 316 are located so that they will each assume the temperature of the local region of substrate 300 on which they are placed. Embodiments of power sources, such as current sources 318, 320, 322, and 324 are configured to supply electrical power to resistive elements 310, 312, 314, and 316. Each of current sources 318, 320, 322, and 324 supply a substantially constant and known current to, respectively, resistive elements 310, 312, 314, and 316 when power is applied to them. The voltage resulting from the application of current to each of resistive elements 310, 312, 314, and 316 changes according to temperature induced changes in the resistance, thereby providing signals related to the temperatures of the regions. Current sources 318, 320, 322, and 324 are coupled to resistive elements 310, 312, 314, and 316 through connection traces, of which trace 326 is representative. The traces provide electrical connection between resistive elements 310, 312, 314, and 316 and current sources 318, 320, 322, and 324. In addition, traces provide an electrical connection between analog to digital converter 328 and the traces that carry current from current sources 318, 320, 322, and 324 to resistive elements 310, 312, 314, and 316. As can be seen from FIG. 3, this particular implementation of a printhead, considerable trace length is used to connect each of resistive elements 310, 312, 314, and 316 to its corresponding current source.

An embodiment of a measuring device, such as analog to digital converter 328 includes 4 channels that each receive a voltage value related to the voltage across resistive elements 310, 312, 314, and 316 resulting from the flow of current. Analog to digital converter 328 converts each of the voltages it receives to corresponding digital values. It should be recognized that other embodiments of power sources and measuring devices could be used to generate the digital values. For example, embodiments of the power source could include voltage sources to supply substantially constant voltages to resistive elements 310, 312, 314, and 316 through the connection traces. Furthermore, an embodiment of the measuring device (such as a current to voltage converter) could include a current measuring device that would provide voltage values corresponding to currents supplied to resistive elements 310, 312, 314, and 316 from the voltage sources. Digital values would then be determined from these voltage values. These digital values are received by an embodiment of a processing device, processor 330. Processor 330 converts, either by using look up tables or computationally, the digital values received from analog to digital converter 328 to digital values that are related to temperatures of substrate 300 in the vicinity of regions 302, 304, 306, and 308. The application of firing pulses to the firing resistors induces a resistance change in the ones of resistive elements 310, 312, 314, and 316 to which firing pulses have been applied. With the current supplied by the corresponding ones of current sources 318, 320, 322, and 324 remaining substantially constant during application, the temperature induced resistance change resulting from the application of filing pulses causes a change in the voltage resulting from the application of the current sources across the traces and resistive elements. The digital values are used to determine the absolute temperature. By comparing the digital values after pulses have applied to the firing resistors and before pulses have been applied to the firing resistors, a measurement of the temperature change of regions of substrate 300 can be determined. Using these temperature related digital values, processor 330 operates an embodiment of a temperature compensation system. One embodiment of the temperature compensation system may adjust the pulse width of the drive signals supplied to the firing resistors so that the temperature of substrate 300 is controlled substantially at a desired temperature. Another embodiment of the temperature compensation system may be used to control resistive heating elements thermally coupled to substrate 300 so that the temperature of substrate 300 is controlled substantially at a desired temperature. Yet another embodiment of the temperature compensation system may be used to control a quantity of ink deposited on a region in response to the measured temperature. In addition, other embodiments of the temperature compensation system could be implemented that combine control of several of the previously mentioned performance aspects.

As previously mentioned, resistive elements 310, 312, 314, and 316 could be formed from material having a known and predetermined resistivity and temperature coefficient of resistance such as aluminum or a tantalum-aluminum alloy. In addition, current sources 318, 320, 322, and 324 are configured to supply a known magnitude of current. By knowing how the resistance changes with temperature and the magnitude of the current supplied to resistive elements 310, 312, 314, and 316, measurement of the voltages can be used to estimate changes in the temperature in the regions of substrate 300. Typically, the material used to form the traces that carry the current to resistive elements 310, 312, 314, and 316 is similar to the material forming resistive elements 310, 312, 314, and 316. Space constraints on substrate 300 and layout considerations for resistive elements 310, 312, 314, and 316 and the traces that couple them to current sources 318, 320, 322, and 324 result in the analog voltages supplied to analog to digital converter 328 including an error component corresponding to the temperature induced changes in the resistance of the traces. To improve the effectiveness of the temperature compensation system that makes use of the digital values corresponding to the measured voltages, an embodiment of the temperature measurement system reduces the contribution of the traces to the measured temperature induced changes in voltage values.

Shown in FIG. 4 is a schematic diagram corresponding to portion 332 of FIG. 3. Resistive elements 310 and 312 are implemented using a serpentine routing of the traces in the region corresponding to the resistive element to increase the fraction of the total temperature induced resistance change (from the trace and the serpentine routed resistive element) that corresponds to the serpentine routed resistive element. The increase in the fraction of the temperature induced resistance change corresponding to the resistive element is accomplished by increasing the path length associated with the resistive element. It should be recognized that other ways of increasing the fraction of the temperature induced resistance change of the resistive element could be used individually or in combination with an increase with the path length. For example, by reducing the width of the path associated with the resistive element, the fraction of temperature induced resistance change corresponding to the resistive element could be increased. Or, the fraction of the temperature induced resistance of the trace could be reduced (thereby increasing the fraction of the temperature induced resistance change corresponding to the resistive element) by increasing the width of the trace, reducing the length of the trace, or routing the trace through regions physically distant on substrate 300 from the firing resistors. By increasing the fraction of the total temperature induced resistance change attributed to the resistive element, the error contributed by the trace to the voltage value is reduced. It should be recognized that other resistive element layouts could be used to obtain a serpentine shape. For example, the resistive element could be structured so that instead having the serpentine path followed in a top to bottom pattern as shown in FIG. 4, the serpentine pattern could be formed by a side to side pattern or a diagonal pattern.

Another way in which to increase the fraction of the total temperature induced resistance change corresponding to the resistive elements (or equivalently reduce the fraction of the total temperature induced resistance change corresponding to the traces) involves the use of materials having different temperature coefficient of resistivities for the resistive elements and the traces. There are several ways in which this could be accomplished. A first way involves using a material having a low temperature coefficient of resistivity for trace 326 relative to the material used for the resistive element. One such material set that could be used is a tantalum-aluminum alloy for the traces and aluminum for the resistive elements. A tantalum-aluminum alloy has a temperature coefficient of resistivity significantly less than aluminum. For aluminum and one particular tantalum-aluminum alloy, the ratio of the aluminum TCR to the tantalum-aluminum alloy TCR is approximately 37. It should be recognized that other material sets having the desired relationship in temperature coefficient of resistivity could be used for the trace and the resistive element to achieve the desired effect. The use of different materials for the trace and resistive element is illustrated in FIG. 4 by using a broken line for trace 326 and a solid line for the parts of resistive element 310 and resistive element 312 shown in FIG. 4. Using materials having this relationship between the temperature coefficient of resistivity for the trace material and the resistive element material will cause a larger fraction of the total temperature induced resistance change to be contributed by the resistive element. In addition, because the resistivity of aluminum is less than that of the tantalum-aluminum alloy, controlling the geometry of the trace and the resistive element will allow an even larger percentage of the total temperature induced resistance change to be associated with the resistive element. For aluminum and one particular tantalum-aluminum alloy, the ratio of the aluminum resistivity to the tantalum-aluminum alloy resistivity is approximately 1/500. The cross sectional area and length (through efficient trace routing for example) of the trace would be controlled to reduce the resistance of the trace. The cross sectional area and length (by following a serpentine path for example) of the resistive element would be controlled to increase the resistance of the resistive element.

A second way involves forming the trace from two materials having temperature coefficients of resistivity so that the resistance changes oppositely for the two materials. By using two materials having temperature coefficients of resistivity of opposite signs, the magnitude of the temperature induced change in resistivity could be reduced. It should be emphasized that to derive a benefit from using materials having coefficients of resistivity of opposite sign it is not necessary that the temperature induced resistance changes caused by the materials cancel. It is beneficial to only reduce (as opposed to eliminate) the temperature induced resistance change corresponding to the traces.

Shown in FIG. 5A is one way to implement the use of two materials having opposite sign temperature coefficients of resistivity for trace 400. The different materials are used in alternating series connected segments of the trace 400. Alternating segments would be used having lengths so that the first and second materials are subjected to substantially the same average temperature over the entire length of the trace. First section 402 of trace 400 is formed from a first material, such as tungsten-silicon-nitride (WSiN), having a negative temperature coefficient of resistivity. Second section 404 of trace 400 is formed from a second material, such as polysilicon, having a positive temperature coefficient of resistivity. The fraction of the total trace length allocated to each of the two materials could be adjusted to reduce the temperature induced resistance change of the entire trace. For example, if the first material had a negative temperature coefficient of resistivity of a smaller magnitude than the magnitude of the positive temperature coefficient of resistivity of the second material, a longer total length of the first material would be used so that aggregate temperature induced resistance change of the trace would be reduced or selected to be substantially equal zero. The alternating segments of the first material and the second material would have a length and width selected to form pairs that provide at least partially offsetting temperature induced resistance changes. The relative lengths of segments of the first material and the second material of a given width that would form a segment pair could be determined by equating a magnitude of the resistance changes, for a given temperature change, of each of the segments forming a segment pair. A temperature induced increase in resistance (causing an increase in voltage drop from the substantially constant current) in one segment formed of the first material would be at least partially offset by a temperature induced decrease in resistance (causing a decrease in voltage drop from the same substantially constant current) in the adjoining segment formed from the second material.

Shown in FIG. 5B is another possible implementation using the first material and the second material. In the implementation of FIG. 513, the first material is used in a first segment 500 in parallel with the second material in a second segment 502. The widths of first segment 500 and second segment 502 would be selected to account for differences in the magnitudes of the temperature coefficients of resistivity so that, in the aggregate, the magnitude of the temperature induced resistance change of the resulting trace from combining first segment 500 and second segment 502 in parallel is reduced over a range of temperatures. Although the configuration of FIG. 5B may not reduce temperature induced resistance changes in the trace as effectively as that shown in FIG. 5A, it can still be designed to provide a beneficial reduction in the magnitude of temperature induced resistance change of the trace over a range of temperatures. Consider the case in which the first material corresponds to a material having a negative temperature coefficient of resistivity and the second material corresponds to a material having a positive temperature coefficient of resistivity. In addition, the widths of first segment 500 end second segment 502 are selected so that the end to end resistance of these traces are substantially equal at a specified temperature (such as a nominal operating temperature of substrate 300). If the average temperature over the length of the combination of first segment 500 and second segment 502 increased, the resistance of first segment 500 would decrease, the resistance of second segment 502 would increase, and the current supplied would be divided so that more current flowed through first segment 500 and less through second segment 502. This would at least partially offset the voltage increase that would occur if the current flowing through second segment 502 had no changed. If the average temperature over the length of the combination of first segment 500 and second segment 502 decreased, the resistance of firs, segment 500 would increase, the resistance of second segment 502 would decrease, and the current supplied would be divided so that more current flowed through second segment 502 and less through first segment 500. This would at least partially offset the voltage decrease that would occur if all the current were forced to flow through first segment 500. It should be recognized that although first segment 500 and second segment 502 are shown as placed side by side in the same plane, they could be fabricated on substrate 300 so that they lie on top of each other.

Although embodiments of the temperature measurement system have been illustrated and described, it is readily apparent to those of ordinary skill in the art that various modifications may be made to these embodiments without departing from the scope of the appended claims.

What is claimed is:

1. An apparatus, comprising:

a substrate;

a resistive element attached to a region of the substrate and formed of a first material having a first temperature coefficient of resistivity; and a pair of traces coupled to the resistive element, attached to the substrate, and formed of a second material having a second temperature coefficient of resistivity with the first material selected so that the first temperature coefficient of resistivity exceeds the second temperature coefficient of resistivity.

2. The apparatus as recited in claim 1, further comprising:

a power source configured to supply electrical power to the resistive element through the pair of traces; and a measurement device coupled to the pair of traces and configured to provide an output related to a resistance of the resistive element.

3. The apparatus as recited in claim 2, wherein:

the power source includes a current source configured to supply a current having a substantially constant magnitude to the resistive element.

4. The apparatus as recited in claim 3, wherein:

the measurement device includes an analog to digital converter arranged to receive a voltage across the pair of traces and the resistive element and configured to generate a digital value corresponding to the voltage.

5. The apparatus as recited in claim 4, further comprising:

a second resistive element attached to a second region of the substrate and formed of the first material, where the resistive element corresponds to a first resistive element;

a second pair of traces coupled to the second resistive element, attached to the substrate, and formed of the second material, where the pair of traces corresponds to a first pair traces;

a third resistive element attached to a third region of the substrate and formed of the first material;

a third pair of traces coupled to the third resistive element, attached to the substrate, and formed of the second material;

a fourth resistive element attached to a fourth region of the substrate and formed of the first material;

a fourth pair of traces coupled to the fourth resistive element, attached to the substrate, and formed of the second material.

6. The apparatus as recited in claim 5, wherein:

the power source further includes a second current source, a third current source and a fourth current source, coupled to, respectively, the second pair of traces, the third pair of traces, and the fourth pair of traces, where the current source corresponds to a first current source coupled to the first pair of traces; and the analog to digital converter includes a first channel, a second channel, a third channel, and a fourth channel, coupled to, respectively, the first pair of traces, the second pair of traces, the third pair of traces, and the fourth pair of traces and configured to generate, respectively, a first digital value, a second digital value, a third digital value, and a fourth digital value, where the digital value corresponds to the first digital value.

7. The apparatus as recited in claim 4, wherein: a serpentine trace placed over the region forms each of the first resistive element, the second resistive element, the third resistive element, and the fourth resistive element.

8. The apparatus as recited in claim 1, wherein: the first material corresponds to aluminum and the second material corresponds to an aluminum-tantalum alloy.

9. The apparatus as recited in claim 8, further comprising:

a power source configured to supply electrical power to the resistive element through the pair of traces; and a measurement device configured to provide an output related to a resistance of the resistive element.

10. The apparatus as recited in claim 9, wherein:

the power source includes a current source configured to supply a current having a substantially constant magnitude to the resistive element; and the measurement device includes an analog to digital converter arranged to receive a voltage across the pair of traces and the resistive element and configured to a digital value corresponding to the voltage.

11. An apparatus, comprising:

a substrate;

a resistive element disposed onto a first region of the substrate and formed of a first material having a first temperature coefficient of resistivity; and a pair of traces coupled to the resistive element and each formed of a first plurality of sections of a second material having a second temperature coefficient of resistivity and a second plurality of sections of a third material having a third temperature coefficient of resistivity.

12. The apparatus as recited in claim 11, wherein:

a magnitude of a temperature coefficient of resistivity of the pair of traces includes a value less than a magnitude of the second temperature coefficient of resistivity and less than a magnitude of the third temperature coefficient of resistivity.

13. The apparatus as recited in claim 12, wherein:

the magnitude of the temperature coefficient of resistivity of the pair of traces includes a value substantially equal to zero.

14. The apparatus as recited in claim 12, wherein:

the first plurality of sections forms a series connection with the second plurality of sections, with ones of the first plurality of sections alternating with ones of the second plurality of sections in the series connection.

15. The apparatus as recited in claim 12, wherein:

each of the first plurality of sections connects in parallel with a corresponding one of the second plurality of sections, forming a plurality of section pairs, with the plurality of section pairs connected in series.

16. The apparatus as recited in claim 12, wherein:

the second material includes polysilicon;

the third material includes WSiN; and the first plurality of sections forms a series connection with the second plurality of sections, with ones of the first plurality of sections alternating with ones of the second plurality of sections in the series connection.

17. The apparatus as recited in claim 12, further comprising:

a power source configured to supply electrical power to the resistive element through the pair of traces; and a measurement device coupled to the pair of traces and configured to provide an output related to a resistance of the resistive element.

18. The apparatus as recited in claim 17, wherein:

the power source includes a current source configured to supply a current having a substantially constant magnitude to the resistive element.

19. The apparatus as recited in claim 18, further comprising:

the measurement device includes an analog to digital converter arranged to receive a voltage across the pair of traces and the resistive element and configured to generate a digital value corresponding to the voltage.

20. A temperature measurement system for use in a printhead having a substrate, comprising a resistive element attached to a region of the substrate in a serpentine shape and formed of a tantalum-aluminum alloy having a first temperature coefficient of resistivity; and a pair of leads coupled to the resistive element, attached to the substrate and having a second temperature coefficient of resistivity less than first temperature coefficient of resistivity.

21. The temperature measurement system as recited in claim 20, further comprising:

a current source coupled to the pair of leads to provide a substantially constant current to the resistive element; and an analog to digital converter coupled to the pair of metal leads and configured to generate a digital value corresponding to a voltage across the pair of metal leads and the resistive element.

22. The temperature measurement system as recited in claim 21, wherein:

each of the pair of leads includes a first plurality of segments formed of a first material having a third temperature coefficient of resistivity and a second plurality of segments formed of a second material having a fourth temperature coefficient of resistivity, with ones of the first plurality of segments alternating and connected in series with ones of the second plurality of segments; and a magnitude of the third temperature coefficient of resistivity and a magnitude of the fourth temperature coefficient of resistivity each exceed a magnitude of the second temperature coefficient of resistivity.

23. The temperature measurement system as recited in claim 22, wherein:

the first material includes polysilicon; and the second material includes WSiN.

24. The temperature measurement system as recited in claim 21, wherein:

each of the pair of leads includes a first plurality of segments formed of a first material having a third temperature coefficient of resistivity and a second plurality of segments formed of a second material having a fourth temperature coefficient of resistivity, each of the first plurality of segments connects in parallel with a corresponding one of the second plurality of segments, forming a plurality of section pairs, with the plurality of section pairs connected in series; and a magnitude of the third temperature coefficient of resistivity and a magnitude of the fourth temperature coefficient of resistivity each exceed a magnitude of the second temperature coefficient of resistivity.

25. A method of measuring temperature of a substrate in a printhead, comprising:

applying a substantially constant current to a series connection of a resistive element attached to a region of the substrate and formed of a first material having a first temperature coefficient of resistivity and a pair of traces attached to the substrate and formed of a second material having a second temperature coefficient of resistivity with the first material selected so that the first temperature coefficient of resistivity exceeds the second temperature coefficient of resistivity;

applying a plurality of signals to a plurality of firing resistors included in the printhead;

changing a resistance of the resistive element and changing a resistance of the pair of traces in response to heating of the resistive element resulting from the applying of the plurality of signals to the plurality of firing resistors; and measuring a voltage across the series connection of the resistive element and the pair of traces.

26. The method as recited in claim 25, wherein:

changing the resistance includes changing a magnitude of the resistance of the resistive element more than changing a magnitude of the resistance of the pair of traces.

27. An imaging device, comprising an interface arranged to receive data from a computer;

a processing device configured to generate image data using the data received from the interface;

an imaging mechanism including a printhead having a substrate and configured to form an image on media corresponding to the image data by ejecting ink from the printhead;

a memory to store the data and the image data;

a resistive element attached to the substrate and formed of a first material having a first temperature coefficient of resistivity;

a pair of traces coupled to the resistive element, attached to the substrate, and formed of a second material having a second temperature coefficient of resistivity with the first material selected so that the first temperature coefficient of resistivity exceeds the second temperature coefficient of resistivity;

a power source configured to supply electrical power to the resistive element through the pair of traces; and a measurement device coupled to the pair of traces and configured to provide an output related to a resistance of the resistive element.

28. The imaging device as recited in claim 27, wherein:

the power source includes a current source configured to supply a current having a substantially constant magnitude to the resistive element; and the measurement device includes an analog to digital converter arranged to receive a voltage across the pair of traces and the resistive element and configured to a digital value corresponding to the voltage.

29. An inkjet printer, comprising an interface arranged to receive data from a computer;

a processing device configured to generate image data using the data received from the interface;

an imaging mechanism including a printhead having a substrate and configured to form an image on media corresponding to the image data by ejecting ink from the printhead;

a memory to store the data and the image data;

a resistive element disposed onto the substrate and formed of a first material having a first temperature coefficient of resistivity; and a pair of traces coupled to the resistive element and each formed of a first plurality of sections of a second material having a second temperature coefficient of resistivity and a second plurality of sections of a third material having a third temperature coefficient of resistivity;

a power source configured to supply electrical power to the resistive element through the pair of traces; and a measurement device coupled to the pair of traces and configured to provide an output related to a resistance of the resistive element.

30. The inkjet printing devices as recited in claim 29, wherein:

a magnitude of a temperature coefficient of resistivity of the pair of traces includes a value less than a magnitude of the second temperature coefficient of resistivity and less than a magnitude of the third temperature coefficient of resistivity.

31. A temperature measurement system, comprising: a substrate;

a resistive element attached to the substrate and formed of a material having a temperature coefficient of resistivity; and a pair of traces coupled to the resistive element, attached to the substrate, and including means for generating a first temperature induced resistance change in the pair of traces less than a second temperature induced resistance change in the resistive element, with the resistive element and the pair of traces subjected to a substantially equal temperature change means for generating an output related to a temperature of the substrate coupled to the pair of traces; and means for generating a digital value from the output coupled to the means for generating an output.

* * * * *